US007358712B2

(12) United States Patent
Shimizu et al.

(10) Patent No.: US 7,358,712 B2
(45) Date of Patent: Apr. 15, 2008

(54) POWER SUPPLY CONTROL CIRCUIT AND CONTROL METHOD THEREOF

(75) Inventors: Kazuyoshi Shimizu, Kawasaki (JP); Akira Nagayama, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 9 days.

(21) Appl. No.: 11/209,644

(22) Filed: Aug. 24, 2005

(65) Prior Publication Data

US 2006/0208668 A1 Sep. 21, 2006

(30) Foreign Application Priority Data

Mar. 18, 2005 (JP) ..... 2005-080668

(51) Int. Cl.
*G05F 5/00* (2006.01)

(52) U.S. Cl. ..... 323/299; 323/908; 363/78; 363/79; 315/308

(58) Field of Classification Search ..... 315/307, 315/308, 309, 224; 363/78, 79; 323/299, 323/301

See application file for complete search history.

(56) References Cited

U.S. PATENT DOCUMENTS 4,777,409 A * 10/1988 Tracy et al. ..... 315/200 R
5,786,671 A * 7/1998 Lee ..... 315/307
5,886,514 A * 3/1999 Iguchi et al. ..... 315/224

FOREIGN PATENT DOCUMENTS

| | | |
|---|---|---|
| JP | 63-200614 | 8/1988 |
| JP | 07-143736 | 6/1995 |
| JP | 07-302142 | 11/1995 |
| JP | 08-030341 | 2/1996 |

* cited by examiner

*Primary Examiner*—Thuy V. Tran
*Assistant Examiner*—Ephrem Alemu
(74) *Attorney, Agent, or Firm*—Bingham McCutchen LLP

(57) ABSTRACT

A power supply control circuit includes: a conducting part configured to be controllable in its a conducting amount for conducting a power supply current to a load circuit;

a current change ratio detecting part detecting a change rate of the power supply current supplied to the load circuit; and a control part controlling the conducting amount of the conducting part according to the change rate of the power supply current detected by the current change detecting part, wherein: the control part carries out feedback control of reducing an increasing rate of the conducting part as the power supply current change rate is larger.

10 Claims, 16 Drawing Sheets

POWER SUPPLY CONTROL CIRCUIT AND CONTROL METHOD THEREOF

BACKGROUND OF THE INVENTION

1. Field of the Invention

The present invention relates to a power supply control circuit and a control method thereof, and, in particular, to a power supply control circuit provided in a board-type module in a hot plug type, and a control method thereof.

2. Description of the Related Art

For example, in an optical communication apparatus or such in which many optical modules are inserted, replacement or such of the respective optical modules is carried out in a hot plug state since the optical communication apparatus operates continuously in terms of its function.

In such a hot plug optical module insertion/removal, a power supply electric current (simply referred to as 'a power supply current', hereinafter) is supplied to the optical module simultaneously upon insertion of the optical module to the optical communication apparatus body for the purpose of starting up the optical module. However, in such a case, a large rush current may flow in relation to circuit impedance concerning the optical module. Thereby, a large voltage drop occurs in the optical communication apparatus accordingly, which may exert influence on operation of other modules in the apparatus.

That is, when a power supply fluctuation occurs due to the above-mentioned voltage drop, stable operation of the other modules in the apparatus may not be ensured. In order to avoid such a situation, it is necessary to control a rush current occurring upon insertion of the optical module, within a predetermined limit.

In such a communication apparatus, a capacitor may be inserted in a power supply line for the purpose of avoiding introduction of power source noise. However, when the capacitor for avoiding power source noise having a large capacitance is inserted for the purpose of improving the power source noise elimination effect, the rush current occurring upon the above-mentioned module hot plug insertion tends to increase. Therefore, it is necessary to improve the power source noise elimination effect with controlling the capacitance of the power source noise elimination capacitor in a low level.

In order to solve this problem, a control of flowing an electric current in such a direction as to cancel the rush current by means of feed-forward control, a control of reducing a resistance of a resister at a certain reduction rate, and so forth have been proposed.

However, such methods involve problems that a time required for starting up the optical module upon insertion thereof becomes longer, a large variation occurs in the rush current actually occurring upon hot plug insertion in relation to circuit operation in the load circuit, and so forth.

Japanese Laid-open Patent Applications Nos. 07-143736, 08-30341, 63-200614 and 07-302142 disclose the related arts.

SUMMARY OF THE INVENTION

The present invention has been devised in consideration of the above-mentioned problems, and an object of the present invention is to provide a power supply control circuit and a control method thereof in which, by making possible to control a rush current occurring upon hot plug insertion sufficiently even when a noise preventing capacitor has a large capacitance, and by making possible to keep in a fixed level an increasing rate (which means an increasing rate per unit of time, the same hereinafter) of a power supply current supplied to a load circuit upon hot plug insertion without regard to circuit operation in a load circuit, a rush current requirement on the side of an apparatus body to which the optical module is inserted can be met, and also, a requirement for a module starting-up completion time requirement on the side of the apparatus body can also be met.

According to the present invention, a power supply control circuit includes: a conducting part configured to be controllable in its conducting amount for conducting a power supply current to a load circuit or an impedance inserting part inserted in a circuit supplying a power supply current to a load circuit, configured to be controllable in its impedance; a current change rate detecting part detecting a change rate of the power supply current supplied to the load circuit; and a control part controlling the conducting amount of the conducting part or the impedance of the impedance inserting part according to the change rate of the power supply current detected by the current change rate detecting part, wherein: the control part carries out feedback control in such a manner as to reduce an increasing rate of the conducting amount of the conducting part or reducing a reduction rate (which means a reduction amount per unit of time, the same hereinafter) in the impedance of the impedance inserting part as the power supply current change rate becomes larger.

Thus, according to the present invention, the power supply current change rate is detected, and the conducting amount of the conducting part or the impedance of the impedance inserting part is controlled according to the detection result. Specifically, feedback control is carried out in such a manner that the increasing rate of the conducting amount of the conducting part or the reduction rate of the impedance of the impedance inserting part may be reduced as the power supply current change rate becomes larger. Thereby, the increasing rate of the power supply current supplied to the load circuit can be kept constant without regard to circuit operation of the load circuit or such.

Thus, according to the present invention, since the increasing rate of the power supply current supplied to the load circuit can be kept constant without regard to circuit operation of the load circuit or such, a rush current upon hot plug insertion of an optical module or such can be sufficiently controlled even for a case where a nose preventing capacitor having a large capacitance is inserted on the side of the load circuit.

Further, since the increasing rate of the power supply current supplied to the load circuit can be kept constant without regard to circuit operation of the load circuit or such, a power supply control circuit in which a rush current requirement on the side of an apparatus body to which the optical module or such is inserted can be met, and also, a requirement for a module starting-up completion time on the side of the apparatus body can be met, can be provided.

BRIEF DESCRIPTION OF THE DRAWINGS

Other objects and further features of the present invention will become more apparent from the following detailed description when read in conjunction with the accompanying drawings.

DETAILED DESCRIPTION OF THE PREFERRED EMBODIMENTS

In a configuration of a first embodiment of the present invention described later, a rush current increasing amount upon hot plug insertion of a module can be kept constant by means of a feedback control such as that mentioned above, thus, a variation in a starting-up time required for starting up the module upon hot plug insertion of the module or a variation in the rush current amount can be well controlled, and also, the starting-up time can be effectively reduced.

Further, in a configuration of a second embodiment of the present invention described later, a transformer is applied in a power supply line for the purpose of preventing lowering of a power supply voltage otherwise occurring due to a voltage drop in a resistor, which is inserted in the power supply line for the purpose of detecting a change in the power supply current. Thereby, the lowering of the power supply voltage can be avoided theoretically.

In a configuration of a third embodiment of the present invention described later, a completion of power supply starting-up operation is detected, and an impedance of a circuit connected in parallel to the power supply current detecting resistor is lowered, for the purpose of preventing lowering of the power supply voltage otherwise occurring due to a voltage drop in the resistor, which is inserted in the power supply line for the purpose of detecting a change in the power supply current. Thereby, the lowering of the power supply voltage otherwise occurring due to a voltage drop in the power supply current detecting resistor can be avoided theoretically.

In a configuration of a fourth embodiment of the present invention, a microprocessor is applied as a control part of such a power supply control circuit, and thus, a circuit size of the circuit can be effectively reduced.

In order to sufficiently control a rush current occurring upon hot plug insertion of a module, a capacitance inserted in a power supply line should be made as smaller as possible. However, as a result, power source noise elimination effect for a noise frequency less than the order of hundreds of kHz may not be ensured. In the fifth embodiment of the present invention, by providing a configuration such as to actively reduce the power source noise in the load circuit, a required power source noise elimination effect can be ensured.

The respective embodiments will now be described in detail with reference to figures.

Figure 1:
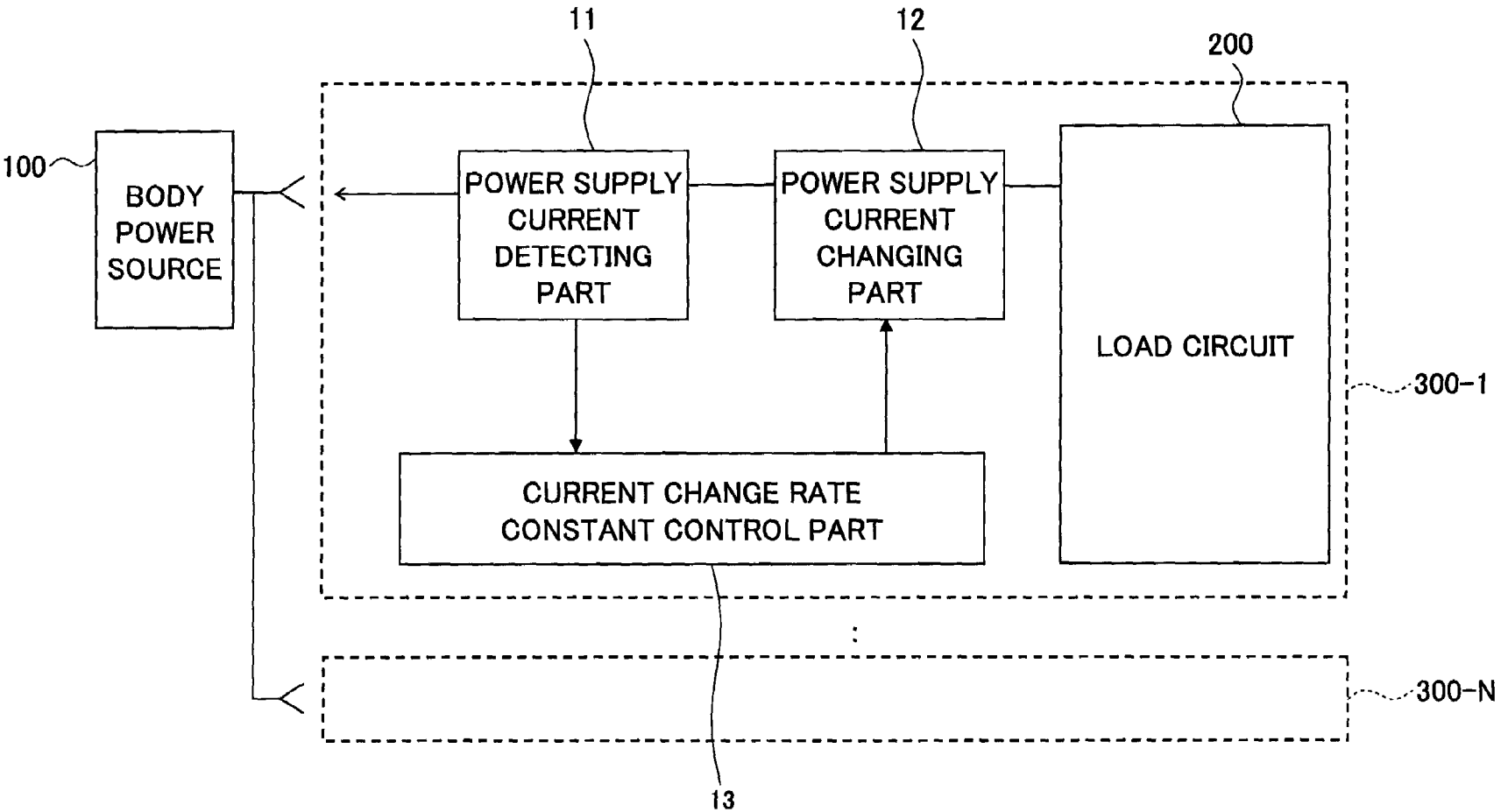
FIG. 1 shows a conceptual block diagram of respective embodiments of the present invention.
Figure 2:
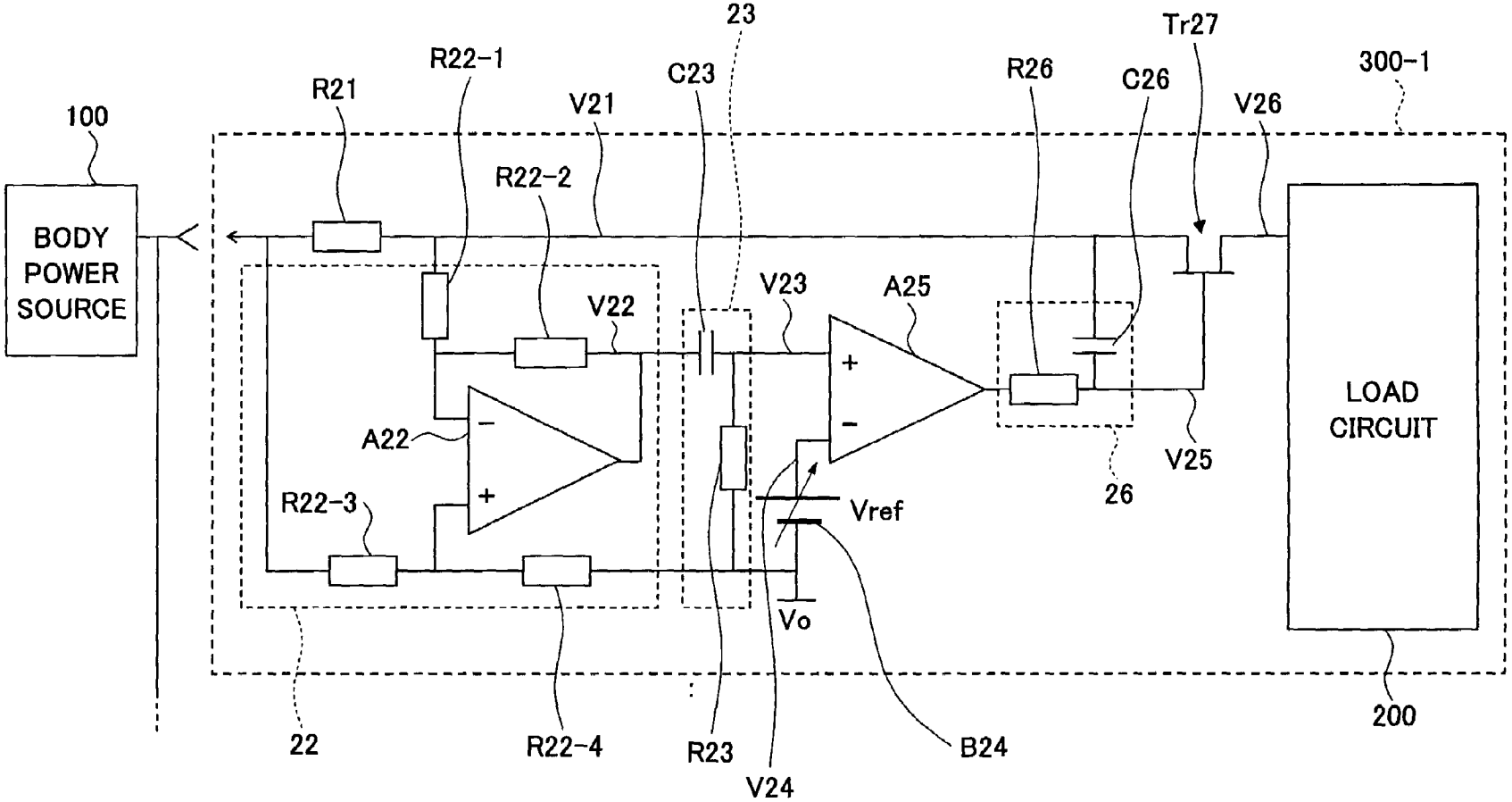
FIG. 2 shows a circuit diagram of a power supply control circuit in a first embodiment of the present invention.

FIG. 1 shows a conceptual diagram of the respective embodiments of the present invention, and FIG. 2 shows a circuit diagram of a power supply control circuit in the first embodiment of the present invention.

In FIG. 1, a power supply current detecting part 11 detects a power supply current; a power supply current changing part 12 changes the power supply current; and a current change amount constant control part 13 controls the power supply current changing part 12 in such a manner that the power supply current detected by the power supply current detecting part 11 may increase at a predetermined slope, that is, a fixed increasing rate thereof may be kept.

The power supply control circuit in the first embodiment of the present invention is made up by the power supply current detecting part 11, the power supply current changing part 12 and the current change amount control part 13. As shown in FIG. 1, power is originally supplied by a body power source 100 which is a power source of the apparatus body to the power supply control circuit which then controls the power supply to a load circuit 200.

A board-type optical module 300-1 having the above-described power supply control circuit and the load circuit 200 mounted thereon is inserted into a predetermined slot of the apparatus body, and a power terminal of the optical module 300-1 is inserted to a power terminal of the apparatus body through which the body power source 100 is connected. As a result, a power supply current is supplied from the body power source 100 to the load circuit 200 of the optical module 300-1 via the power supply control circuit.

This optical module 300-1 is of a so-called hot plug type, and is configured so as to allow insertion/removal of the module to/from the apparatus body in a hot plug state of the apparatus body.

In the apparatus body, many slots are provided other than that in which the optical module 300-1 is inserted, and other optical modules 300-2, . . . , 300-N and so forth may be inserted/removed to/from them also in a hot plug state in the same manner, which modules may have the same functions as that of the optical module 300-1 or may have any different functions.

As will be described with reference to FIG. 14 and so forth, the apparatus body is of an optical communication apparatus for example, the above-mentioned optical modules 300-1, 300-2, . . . , 300-N, are provided for respective ones of many optical communication circuits with which the optical communication apparatus carries out optical communication, and have functions of transmitting/receiving optical signals to/from the respective communication circuits.

As shown in FIG. 2, the power supply control circuit includes a resistor R21 for detecting a power supply current; a voltage shifting circuit 22 amplifying or attenuating an input voltage difference so as to shift it in a predetermined reference voltage; a differential circuit 23; a reference voltage source circuit B24 generating a reference voltage Vref; a differential amplifier A25; a time-constant circuit (integrating circuit) 26; and a transistor Tr27 for controlling the power supply current.

In this configuration, the power supply current detecting circuit R21 and the voltage shifting circuit 22 correspond to the power supply current detecting part 11 of FIG. 1; the differential circuit 23, the differential amplifier A25, the reference voltage source circuit B24 and the time-constant circuit 26 correspond to the current change amount constant control part 13; and the transistor Tr27 corresponds to the power supply current changing part 12.

As shown, the voltage shifting circuit 22 includes an operational amplifier A22 as well as respective resistors R22-1, R22-2, R22-3 and R22-4, and forms an inverting amplifier circuit.

The differential circuit 23 has a configuration in which a capacitor C23 and a resistor R23 are connected in an L-shape. The time-constant circuit (integrating circuit) 26 is made of a circuit in which a capacitor C26 and a resistor R26 are connected in an L-shape.

In the configuration of FIG. 2, the power supply current detecting circuit of the resistor R21 inserted in a power supply line converts the power supply current supplied to the load circuit 100 from the body power source 100, into a voltage amount. The operational amplifier A22 of the voltage shifting circuit 22 inverts and amplifies the voltage amount corresponding to the power supply current.

The larger the power supply current supplied to the load circuit 200 from the body power source 100 becomes, the larger a voltage drop amount in the resistor R21 becomes accordingly. As a result, the voltage applied to the inverted input terminal of the operational amplifier A22 becomes smaller. Further, as mentioned above, the voltage shifting circuit 22 forms the inverting amplifier circuit, and thus, the smaller the voltage applied to the inverted input terminal of the operational amplifier A22 becomes, the larger the output value obtained from the inverting and amplifying becomes accordingly. As a result, the larger the power supply current supplied to the load circuit 200 from the body power source 100 becomes, the higher the output voltage of the voltage shifting circuit 22 becomes.

Figure 3:
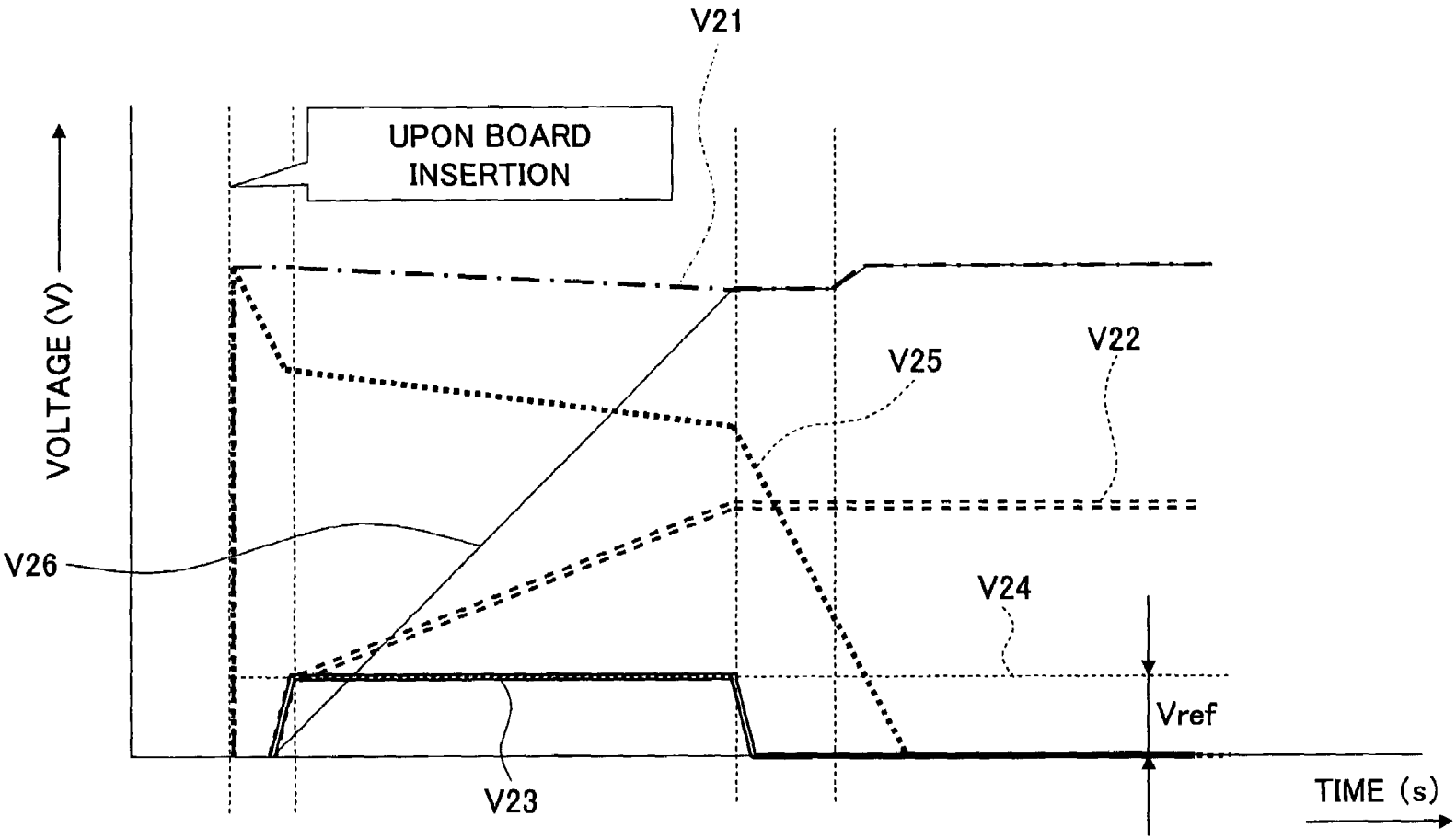
FIG. 3 shows a waveform diagram of the power supply control circuit in the first embodiment of the present invention.

FIG. 3 is a waveform diagram showing voltage values of respective points in the circuit shown in FIG. 2. As shown, upon insertion of the optical module 300-1 in the apparatus body (simply referred to as 'upon board insertion', hereinafter), the voltage V21 on the power supply line increases stepwise. However, since the transistor Tr27 is in a turned off state upon board insertion and thus is in a high impedance state, the transistor Tr27 is in a non-conductive state. Accordingly, the power supply current hardly flows to the load circuit 200 even upon board insertion.

As this transistor Tr27, one in a type such that it is in a turned off state when its gate-source voltage is zero is applied. Also, the capacitor C26 of the time-constant circuit 26 connected between the gate and source thereof is in a not-charged state upon board insertion. As a result, the gate-source voltage of the transistor Tr27 is zero, and thus, as mentioned above, the transistor Tr27 is in the turned off state upon board insertion.

As a result, as mentioned above, even when the voltage V21 on the power supply line increases stepwise, the power supply current flowing there is kept zero initially. However, as a result of the power supply voltage being thus applied to the power supply line, charging in the capacitor C26 of the time-constant circuit 26 starts accordingly. As a result, the power supply current flows a little there. This current amount is converted into the voltage amount by means of the resistor R21 acting as the power supply current detecting circuit, this is then shifted into a reference voltage level by means of the voltage shifting circuit 22, and then, is applied to the differential circuit 23.

Thus, after the power supply current is converted into the voltage amount, the voltage shifting part 22 converts the voltage applied by the resistor R21 into a voltage having a value with respect to a reference voltage Vo.

After that, a voltage obtained from differentiating by means of the differential circuit 23 is compared with the reference voltage Vref by the differential amplifier A25. Thanks to the function of the differential circuit 23, the voltage V23 compared with the reference voltage Vref in the differential amplifier A27 represents a change rate of the voltage V22 corresponding to the above-mentioned power supply current. Accordingly, by controlling this voltage V23 to keep it in a fixed level, the increasing rate of the power supply current can be kept constant accordingly.

That is, as the above-mentioned voltage V23 is kept constant, the output voltage of the differential amplifier A25 is kept constant, and as a result, a voltage applied to the capacitor C26 of the time-constant circuit 26 is kept constant. As a result, a charging amount (charging rate) in the capacitor C26 is kept constant.

As a result, the gate voltage V25 of the transistor Tr27 decreases at a constant reduction rate (see FIG. 3), and thereby its gate-source voltage (that is, the terminal voltage across the capacitor C26 (V21-V25)) increases at a constant increasing rate. As a result, the impedance in the transistor Tr27 decreases at a constant reduction rate, and thus, during this period, the power supply current flowing through the transistor Tr27 and then being supplied to the load circuit 200 increases at a constant increasing rate (V22 in FIG. 3) consequently.

When the increasing rate of the power supply current exceeds a predetermined value, and as a result the voltage V23 representing the increasing rate of the power supply current exceeds the reference voltage Vref, the output voltage of the differential amplifier A25 increases. As a result the voltage applied to the capacitor C26 of the time-constant circuit 26 decreases, and as a result, the charging rate in the capacitor C26 decreases. As a result, the reduction rate of the impedance of the transistor Tr27 decreases, and thus, the increasing rate of the power supply current decreases.

Thus, a feedback control is carried out. Thereby, the increasing rate of the power supply current supplied to the load circuit 200 from the body power source 100 is kept constant. Similarly, as being represented by the voltage V26 in FIG. 3, the power supply voltage applied to the load circuit 200 increases at a constant increasing rate. This is because, as a result of the impedance in the transistor Tr27 decreasing at a constant rate as mentioned above, a voltage drop in the transistor Tr27 with respect to the power supply voltage of the body power source 100 decreases at a constant reduction rate.

Further, as a result of the power supply voltage V26 applied to the load circuit 200 thus increasing, it becomes equal to the power supply voltage V21 directly coupled to the body power source 100, and thus, the power supply starting-up operation is completed. At this time, the transistor Tr27 reaches a saturated conductive state, and then, the impedance thereof hardly changes even upon a further increase in its gate-source voltage.

As a result, after that, the power supply current supplied to the load circuit 200 is kept constant (see V22 in FIG. 3). As a result, the output voltage of the differential circuit 23 become zero, and thus, the output voltage of the differential amplifier A25 decreases. Thereby, the gate-source voltage of the transistor Tr27 further increases. However, since the transistor Tr27 has already reached the saturated conductive state as mentioned above, the impedance hardly decreases any more, and thus, the power supply current hardly changes (see V22, of FIG. 3).

Thus, in the present embodiment, the increasing rate of the power supply current supplied to the load circuit 200 from the body power source 100 is monitored, and the feedback control is carried out in such a manner as to make the power supply current constant. As a result, without regard to a condition in the load circuit 200, the constant power supply current increasing rate is kept until the terminal voltage V26 of the load circuit 200 reaches the power supply voltage of the body power source 100. As a result, without regard to a circuit operation in the load circuit 200, such a control can be achieved that a time required for a starting-up operation carried out upon board insertion of the optical module 300-1 may not vary.

As a result, even when a power source noise elimination capacitor is connected on the side of the load circuit 200, and also, its capacitance is increased so that higher noise elimination effect is sought, a rush current occurring upon board insertion is not affected thereby. Accordingly, a degree of freedom in determination of the capacitance of the power source noise elimination capacitor improves.

Further, since such a control can be achieved that the power supply current increasing rate upon power supply starting-up operation upon board insertion of the optical module 300-1 can be fixed, the rush current can be effectively controlled, and thus, influence on operation of other circuits in the apparatus body can be controlled within a predetermined limit.

That is, according to the first embodiment, the feedback control is applied for achieving the constant current increasing rate, in comparison to the related art in which the current increasing rate is controlled in a feed-forward manner as mentioned above. Thereby, the current increasing rate can be controlled in a fixed value, and also, high speed starting up can be achieved.

Further, a possible non-linear increase in the power supply current due to circuit operation in the load circuit 200 (for example, due to a reset cancellation operation or such) can be coped with. For example, for a case where a requirement for a rush current on a power supply line is 50 mA/ms for a case of finally supplying a power supply current on the order of 1A, the order of 1 second is required in the related art. In contrast thereto, according to the embodiment of the present invention, this stating-up time can be controlled in 20 ms theoretically, and, even considering possible variations, starting up within 100 ms can be achieved.

A second embodiment of the present invention is described next.

Figure 4:
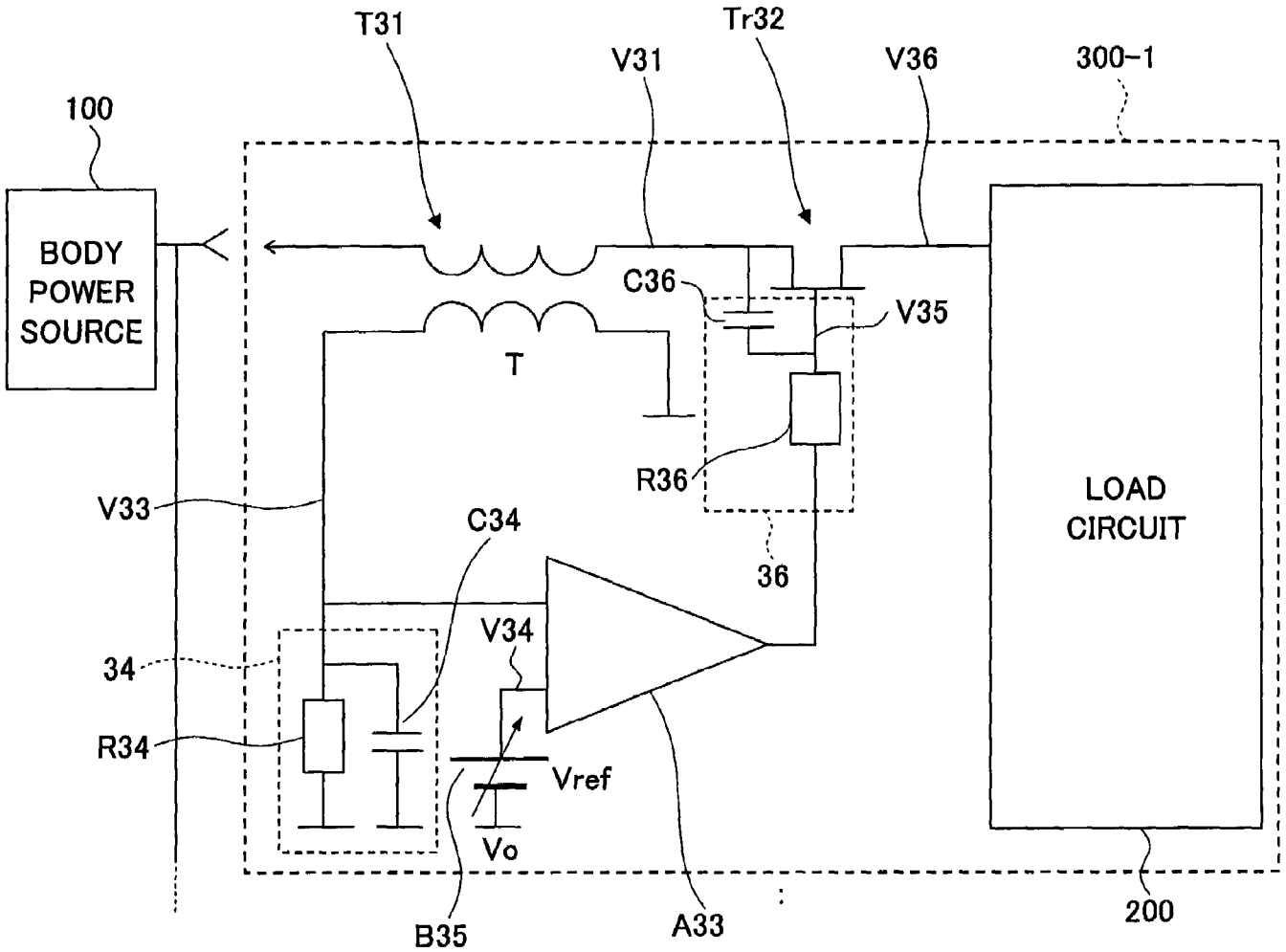
FIG. 4 shows a circuit diagram of a power supply control circuit in a second embodiment of the present invention.

FIG. 4 shows a circuit diagram of a power supply control circuit in the second embodiment of the present invention.

As shown, the power supply control circuit includes a transformer T31 as a power current change rate detecting circuit detecting a change in the power supply current; a transistor Tr32 as a power supply current changing circuit changing the power supply current; a differential amplifier A33; a current-to-voltage converting circuit 34 converting an electric current into a voltage; a reference voltage source circuit B35 generating a reference voltage; and a time-constant circuit 36.

The transformer T31 and the current-to-voltage converting circuit 34 correspond to the power supply current detecting part 11 of FIG. 1; the differential amplifier A33, the reference voltage source circuit B35 and the time-constant circuit 36 correspond to the current change amount constant control part 13; and the transistor Tr32 corresponds to the power supply current changing part 12.

The current-to-voltage converting circuit 34 is made of a parallel circuit of a resistor R34 and a capacitor C34; and the time-constant circuit (integrating circuit) 36 is made of a circuit in which a capacitor C36 and a resistor R36 are connected in an L-shape.

In the configuration of FIG. 4, by means of the transformer T31, a change rate of the power supply current supplied to the load circuit 200 from the body power source 100 is taken as a corresponding electric current amount. This is then converted into a voltage amount by means of the current-to-voltage converting circuit 34. Then, in order to make this voltage constant, it is compared with a reference voltage Vref generated by the reference voltage source circuit B35, by the differential amplifier A33. The differential amplification output voltage thereof as the comparison result is applied to the time-constant circuit 36. Thus, the increasing rate of the power supply current supplied to the load circuit 200 from the body power source 100 is kept constant.

Figure 5:
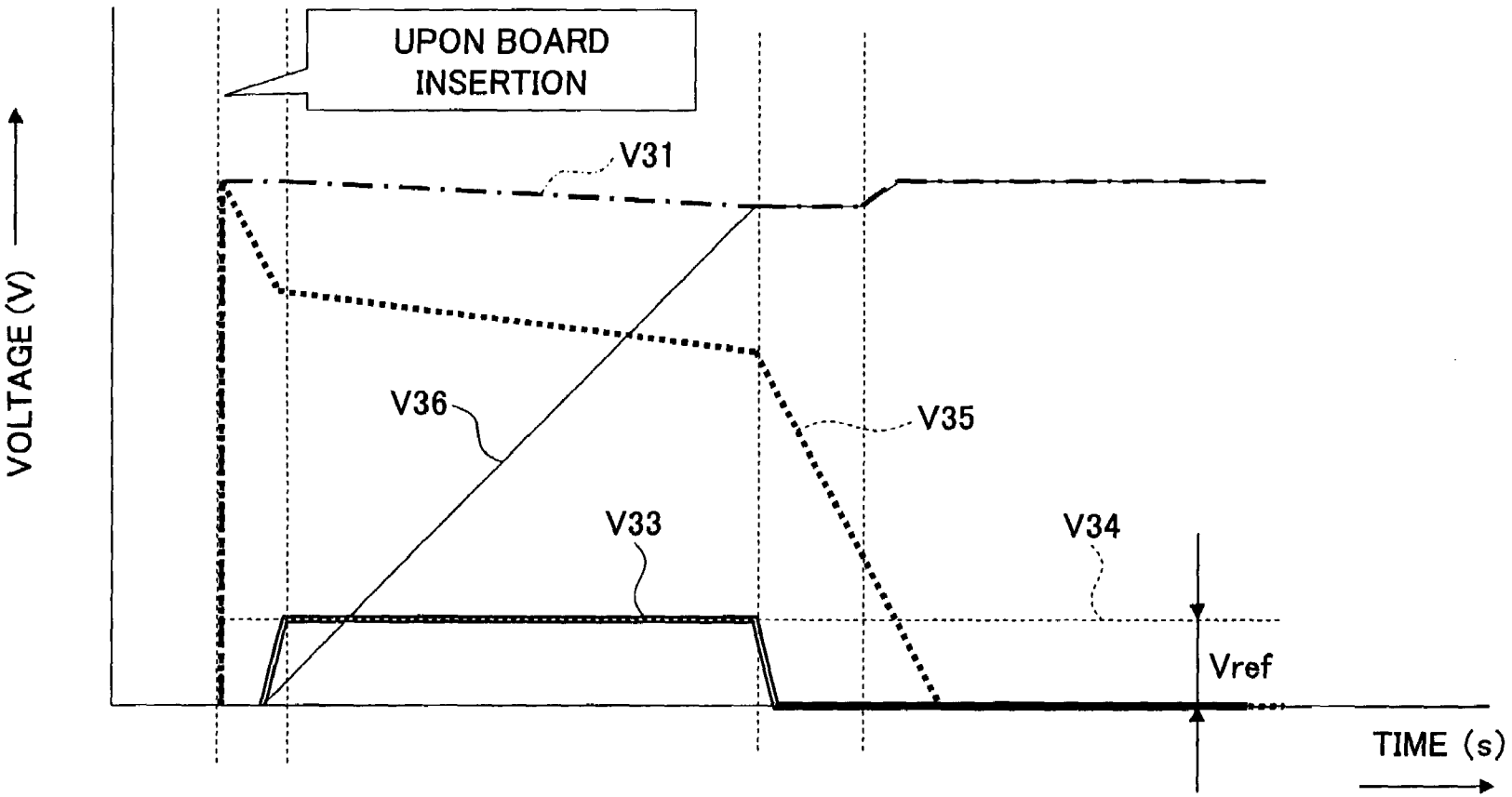
FIG. 5 shows a waveform diagram of the power supply control circuit in the second embodiment of the present invention.

FIG. 5 shows waveforms of voltage values of respective points in the circuit of FIG. 4.

The circuit of the second embodiment has functions basically the same as those of the first embodiment described above. In the circuit of FIG. 4, the circuit configuration of the differential amplifier A33, the integrating circuit 36 and the transistor Tr32 is the same as that of the differential amplifier A25, the integrating circuit 26 and the transistor Tr27, and they have the same functions accordingly.

That is, in the circuit of FIG. 4, the power supply current amount change rate taken by means of the transformer T31 is converted into a voltage V33 by means of the current-to-voltage converting circuit 34, and this is compared with the reference voltage Vref by means of the differential amplifier A33. When the voltage V33 corresponding to the power supply current amount exceeds the reference voltage Vref as a result of the comparison, a charging rate in the capacitor C36 of the time-constant circuit 36 is decreased through operation as in the first embodiment, and thus, the reduction rate of the impedance of the transistor Tr32 is decreased accordingly. As a result, the increasing rate of the power supply current supplied to the load circuit 200 after flowing through this transistor Tr32 is reduced accordingly.

By means of this feedback control, the same as the above-described first embodiment, the power supply current supplied to the load circuit from the body power source 100 can be made to increase at a predetermined increasing rate, without regard to condition on the side of the load circuit 200.

In the second embodiment, in comparison to the first embodiment in which the resistor R21 is inserted in the power supply line for detecting the power supply current, the transformer T31 is inserted instead. As a result, a power consumption and a voltage drop occurring due to the resistor R21 in the first embodiment can be theoretically eliminated, and thus, effective utilization of the power can be achieved.

A third embodiment of the present invention is described next.

Figure 6:
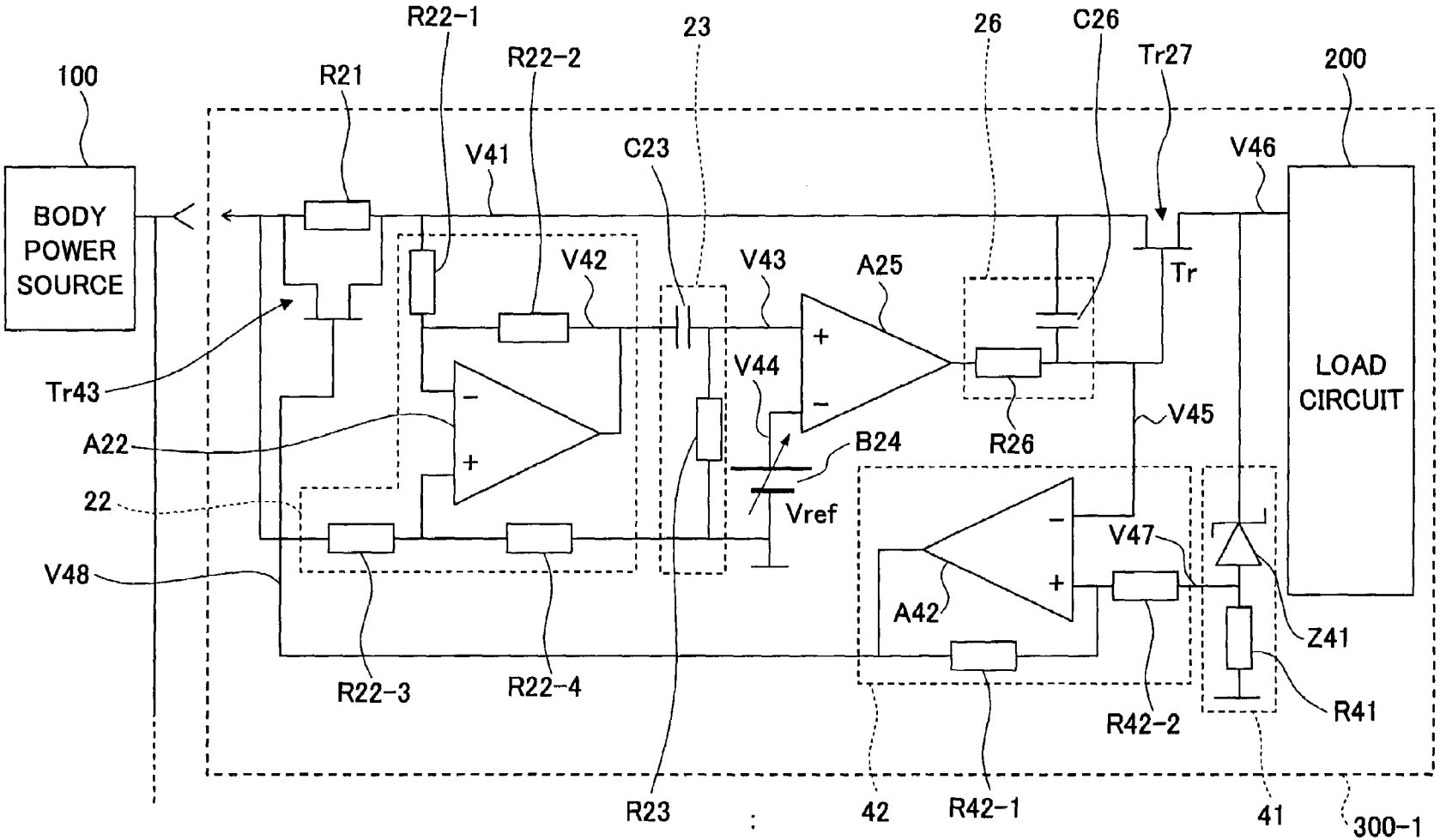
FIG. 6 shows a circuit diagram of a power supply control circuit in a third embodiment of the present invention.

FIG. 6 shows a circuit diagram of a power supply control circuit in the third embodiment of the present invention.

As shown, the power supply control circuit includes a voltage shifting circuit 41, a hysteresis comparator 42, and a transistor Tr43 provided in parallel to a resistor R21, acting as a switch circuit Tr43 for switching high/low (H/L) of its impedance. This transistor Tr43 has such a configuration as to enter a state of turned off during its gate voltage in a low level, and enters a state of turned on during its gate voltage in a high level.

The voltage shifting circuit 41 is made of a series circuit of a Zener diode Z41 and a resistor R41, and the comparator 42 includes an operational amplifier A42 and resistors R42-1 and R42-2.

V47 denotes a voltage obtained from shifting a voltage V46 supplied to the load circuit 200 by a Zener voltage Vz, V45 denotes a power supply starting-up control voltage (that is, a gate voltage of a transistor Tr27), and V46 denotes a power supply voltage applied to the load circuit 200.

The other circuit configuration, that is, a voltage shifting circuit 22, a differential circuit 23, a reference voltage source circuit B24, a differential amplifier A25, a time-constant circuit 26 and the transistor Tr27 are the same as those of the first embodiment, i.e., the configuration of FIG. 2, the functions thereof are the same, and duplicated description is omitted.

Figure 7:
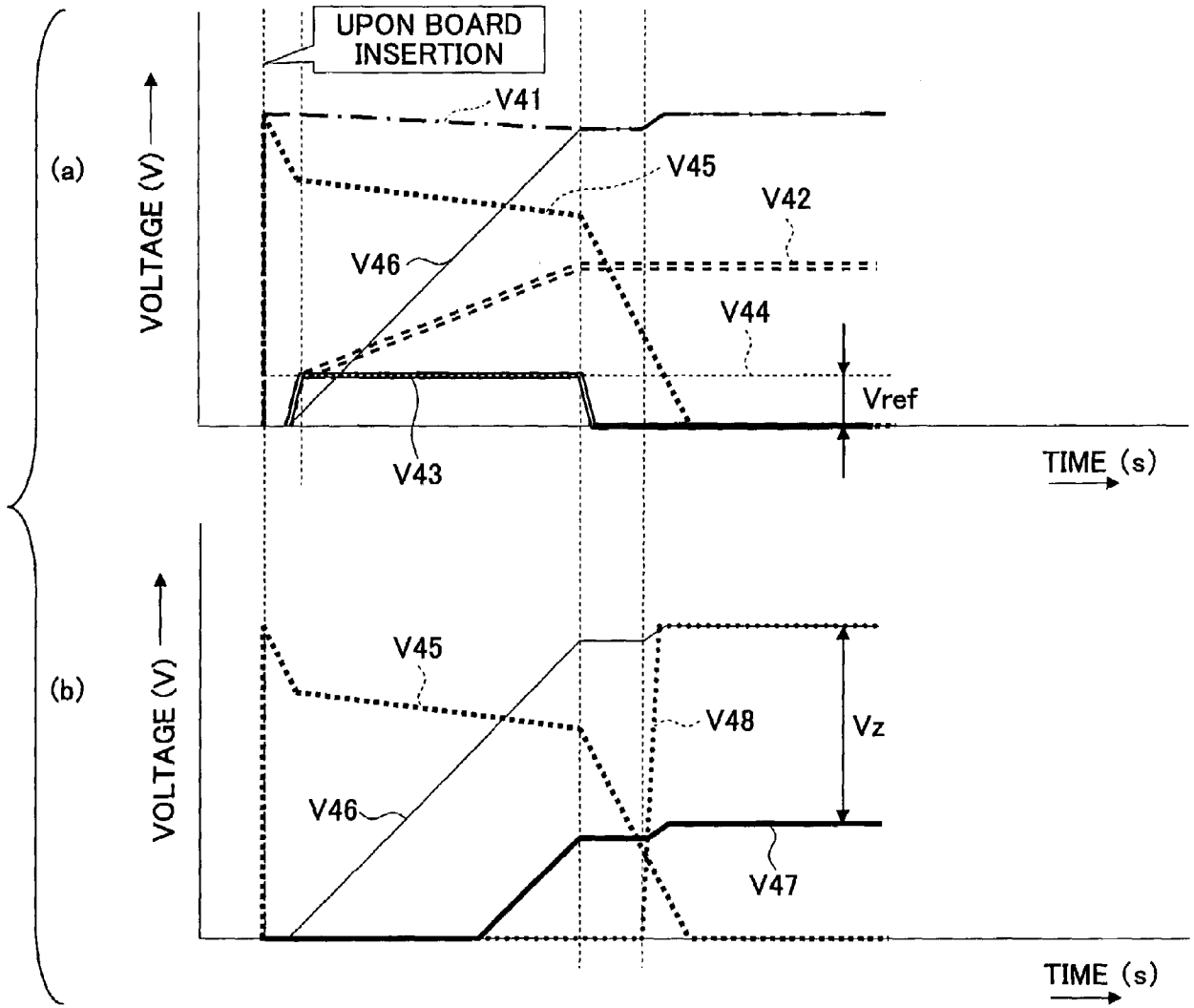
FIG. 7 shows a waveform diagram of the power supply control circuit in the third embodiment of the present invention.

FIG. 7, (a) shows waveforms of voltages at respective parts in the circuit of FIG. 6, and corresponds to FIG. 3. Since circuit operation in the circuit of FIG. 6 is basically the same as that in the circuit of FIG. 2, the contents of FIG. 7, (a) are the same as those of FIG. 3, and duplicated description is omitted.

In the circuit of FIG. 6, operation the same as that described above for the first embodiment is carried out (see FIG. 7, (a)). During this operation, as shown in FIG. 7, (a), the voltage V46 applied to the load circuit 200 increases at a constant increasing rate. The transistor Tr43 connected in parallel with the power supply current detecting resistor R21 has the output voltage of the comparator 42 connected to its gate. Then, while the voltage V47 applied to the non-inverted input terminal of the comparator 42 is lower than the voltage V45 applied to its inverted input terminal, the output voltage of the comparator 42 is low. As a result, the transistor Tr43 keeps its turned off state.

FIG. 7, (b) shows part of FIG. 7, (a), that is, it shows the gate voltage V45 of the transistor Tr27 and the power supply voltage V46 applied to the load circuit 200. Further, FIG. 7, (b) also shows the voltage V47 dropped from the voltage V46 by the Zener voltage Vz of the Zener diode Z41.

In the circuit of FIG. 6, during the power supply starting-up operation, that is, until the voltage V46 applied to the load circuit 200 reaches the power supply voltage V41 of the body power source 100, the gate voltage V45 of the transistor Tr27 is in a relatively high level, as described above for the first embodiment with reference to FIG. 3. Thereby, during this period, the voltage V45 is higher than the voltage V47 dropped from the power supply voltage V46 by the Zener voltage Vz (see FIG. 7, (b)).

As a result, during this period, the output of the comparator 42 is low, the gate voltage of the transistor Tr43 connected in parallel with the power supply current detecting resistor R21 is made low, and thereby, the transistor Tr43 is in a turned off state. As a result, the resistor R21 is made effective, and thus, it executes the power supply current detecting function as described above for the first embodiment.

On the other hand, after the power supply staring-up operation is finished, that is, after the power supply voltage V46 applied to the load circuit 200 reaches the power supply voltage V41 of the body power source 100, the voltage V45 applied to the gate of the transistor Tr27 decreases rapidly as shown in FIG. 7, (a) or (b).

The voltage shifting circuit 41 detects that, as a result of the voltage V45 applied to the gate of the transistor Tr27 thus decreasing, this voltage becomes lower than the voltage V47 which is lower than the power supply voltage V46 applied to the load circuit 200 by the Zener voltage Vz (see FIG. 7, (b)). That is, the comparator 42 is inverted as a result of V45 thus becoming lower than V47, and as a result, its output voltage becomes high. As a result, the voltage applied to the gate of the transistor Tr43 connected in parallel with the power supply current detecting resistor R21 becomes high. As a result, the transistor Tr43 is turned on, and thus, the power supply current detecting resistor R21 is substantially bypassed by the transistor Tr43.

According to the third embodiment, the power supply current detecting resistor R21 is thus bypassed after the completion of the power supply starting-up operation. As a result, the power consumption and the voltage drop otherwise occurring in the resistor R21 does not actually occur. Accordingly, the power supply current increasing rate can be kept constant as in the first embodiment, as well as effective utilization of the power can be achieved.

A fourth embodiment of the present invention is described next.

Figure 8:
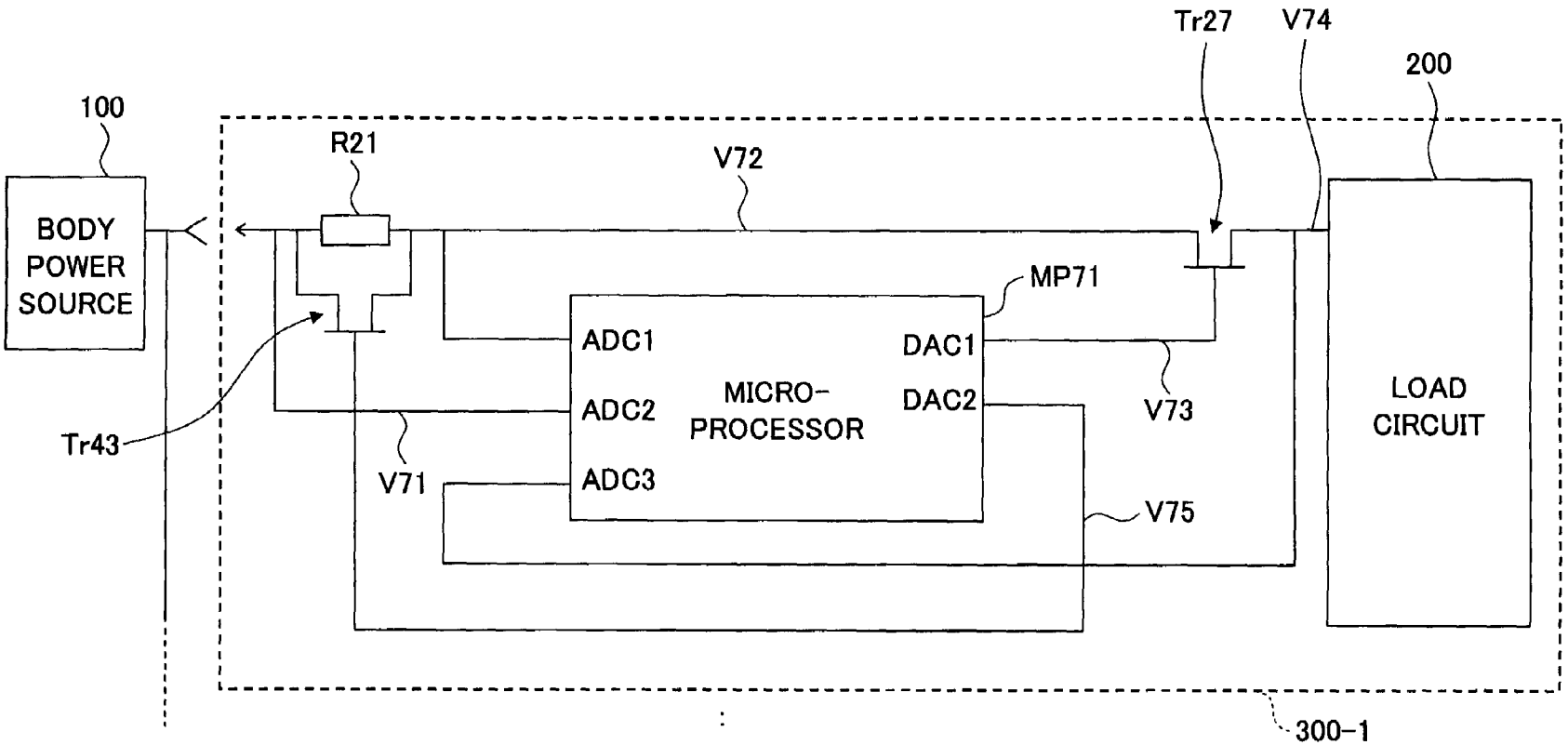
FIG. 8 shows a circuit diagram of a power supply control circuit in a fourth embodiment of the present invention.
Figure 9:
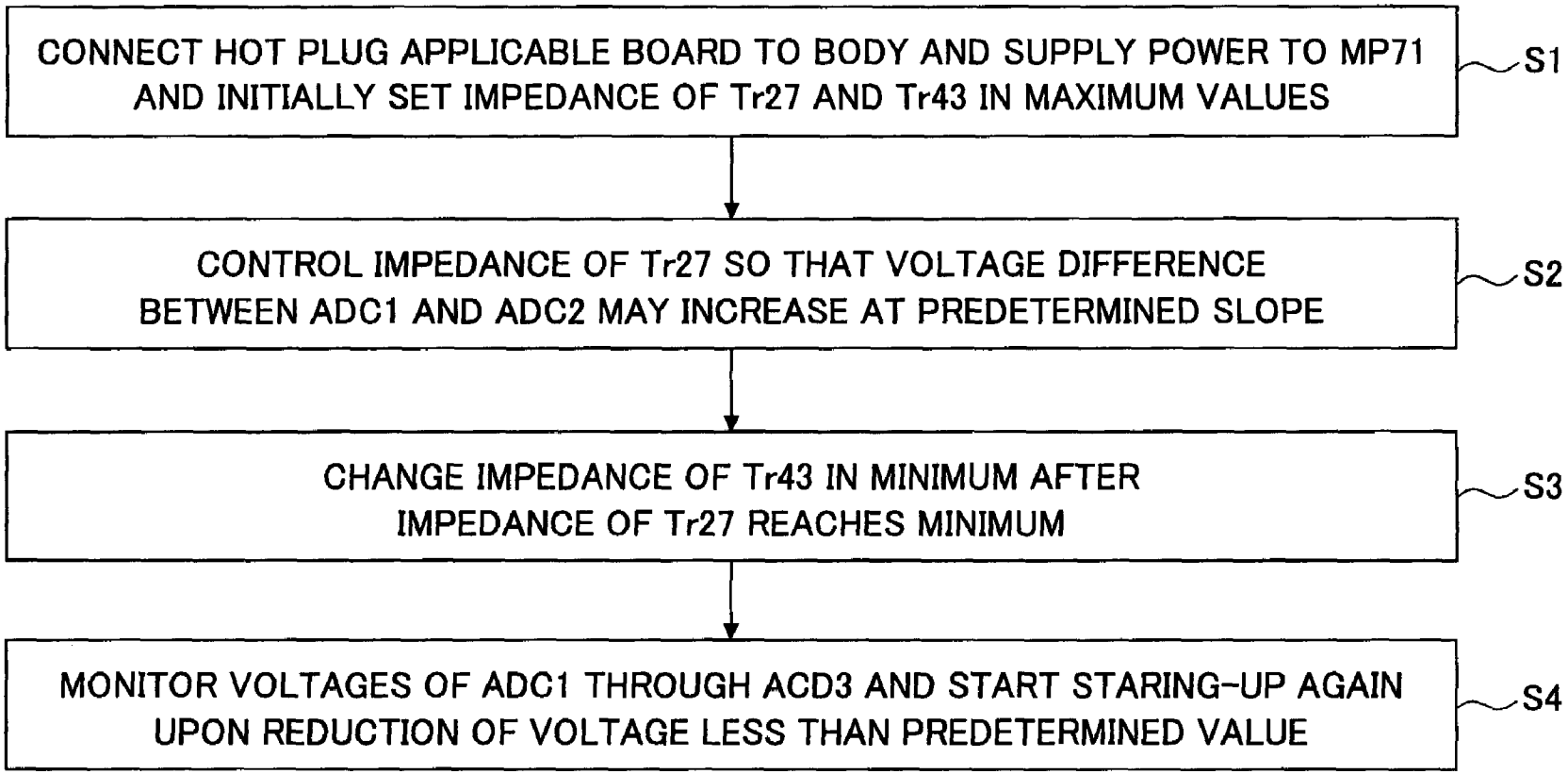
FIG. 9 shows an operation flow chart of the power supply control circuit in the fourth embodiment of the present invention.

FIG. 8 shows a circuit diagram of a power supply control circuit in the fourth embodiment of the present invention. FIG. 9 shows an operation flow chart of the power supply control circuit in the fourth embodiment concerning power supply stating-up operation.

As shown in FIG. 8, the power supply control circuit includes a microprocessor MP71 including analog-to-digital converters (abbreviated as ADC, hereinafter) and digital-to-analog converters (abbreviated as DAC, hereinafter). Thus, in the fourth embodiment, for the configuration of the third embodiment shown in FIG. 6 for example, the circuit configuration other than the power supply current detecting resistor R21, the transistor Tr43 connected in parallel therewith and the transistor Tr27 as the power supply current changing part, is replaced by the microprocessor MP71.

In the fourth embodiment, as an initial setting of the microprocessor MP71 to which power is directly supplied by the body power source 100 (V71 in FIG. 8), such control voltages are applied to the gates of the respective transistors Tr27 and Tr43 that these transistors may have the maximum impedances, respectively, via DAC1 and DAC2 (Step S1 of FIG. 9).

After that, as in the first embodiment, the resistor R21 converts the power supply current into a voltage amount, and a voltage across it is input to ADC1 and ADC2 of the microprocessor MP71. As shown in Step S2 of FIG. 9, the microprocessor MP71 controls output of DAC1 in such a manner that the voltage between the ADC1 and ADC2, that is, an amount corresponding to the power supply current may increase at a predetermined increasing rate. That is, by controlling the gate voltage of the transistor Tr27 via DAC1, the impedance thereof is controlled accordingly.

Figure 10:
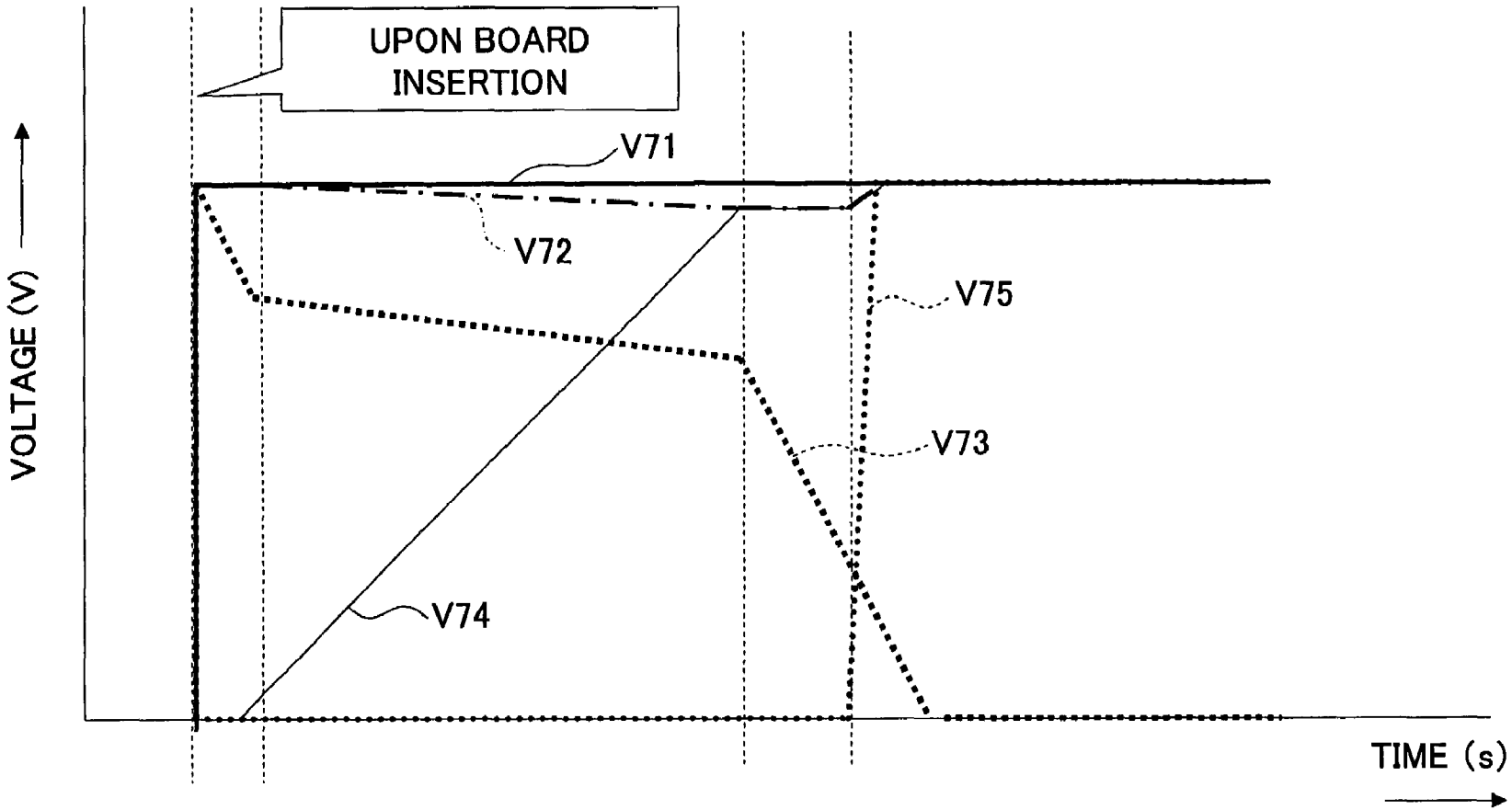
FIG. 10 shows a waveform diagram of the power supply control circuit in the fourth embodiment of the present invention.

Specifically, by decreasing the output voltage of DAC1, the gate voltage of the transistor Tr27 is decreased (V73 in FIG. 10), and thereby, its impedance is decreased. As a result, the electric conducting amount of the transistor Tr27 increases, and thus, the power supply current supplied to the load circuit 200 from the body power source 100 is increased. Then, the microprocessor MP71 detects this increasing rate via the power supply current detecting resistor R21, and based thereon, feedback control is carried out such that the power supply current increasing rate may be kept constant.

Then, in Step S3 of FIG. 9, when the impedance in the transistor Tr27 reaching the minimum value is detected from the output voltage V73, i.e., the gate voltage of the transistor Tr27, that is, when the transistor Tr27 has reached its saturated conductive state, the microprocessor MP71 determines that the power supply starting-up operation has been completed. In response thereto, the output voltage of DAC2 supplying the gate voltage of the transistor Tr43 is controlled (V75 in FIG. 10) in such a manner that the impedance of the transistor Tr43 acting as the switching circuit may be minimum, that is, the resistor R21 acting as the current-to-voltage converting part may be bypassed therewith.

As a result, the same as in the third embodiment, the power supply current detecting resistor R21 is bypassed after the completion of the power supply starting-up operation, thereby the power consumption and the voltage drop otherwise occurring due to the resistor R21 does not occur theoretically, and thus, effective utilization of the power can be achieved after the completion of starting up, while the power supply current increasing rate can be kept constant during the power supply starting-up operation.

As in Step S4, after the completion of the power starting-up operation, the voltages of the respective parts are monitored via ADC1, ADC2 and ADC3. When these values lower than predetermined levels, the microprocessor MP71 determines that the relevant optical module is drawn out from the apparatus body. After that, when the optical module is again inserted into the apparatus body, this matter is detected via ADC2. And then, the power supply starting-up operation is executed again from Step S1 the same as described above.

In the fourth embodiment, as hardware which executes control operation, the microprocessor MP71 is applied instead of the respective analog circuit devices. As a result, the circuit size of the power supply control circuit can be effectively reduced as well as power consumption can be effectively reduced.

A fifth embodiment of the present invention is described next.

Figure 11:
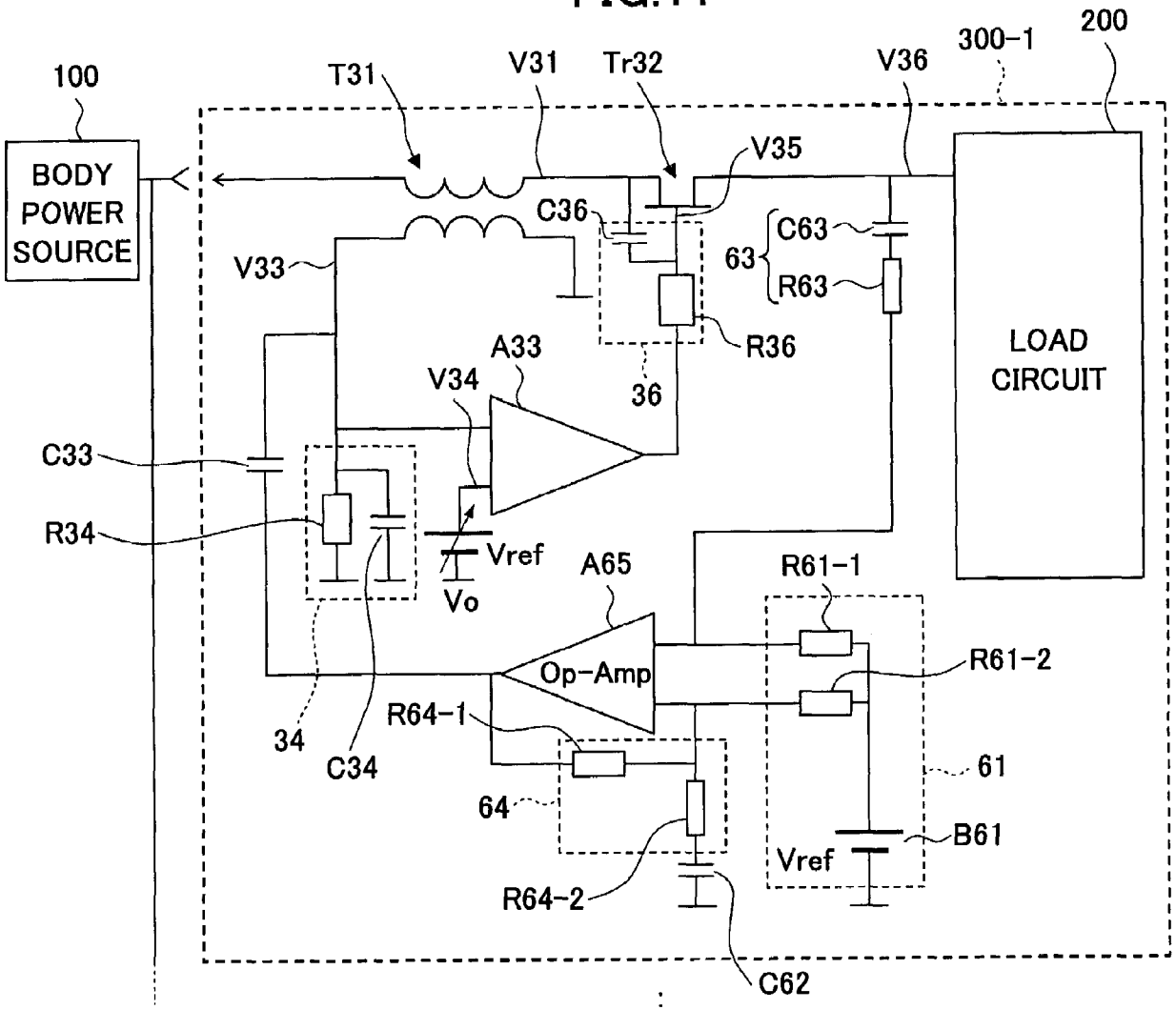
FIG. 11 shows a circuit diagram of a power supply control circuit in a fifth embodiment of the present invention.

FIG. 11 shows a circuit diagram of a power supply control circuit in the fifth embodiment of the present invention.

As shown, the power supply control circuit includes a reference voltage source circuit 61 providing a direct-current bias to the input of a differential amplifier A65; an alternate-current coupling circuit C62 applying a stable voltage to one input terminal of the differential amplifier A65; an alternate-current coupling circuit C63 and R63 applying a power source noise component of the load circuit 200 to the other input terminal of the differential amplifier A65; and a feedback circuit 64 for setting a feedback amount of the differential amplifier A65.

The reference voltage source circuit 61 includes a voltage source B61 and resistors R61-1 and R61-2; the alternate-current coupling circuit C62 is made of a capacitor C62; the alternate-current coupling circuit 63 includes a capacitor C63 and a resistor R63; and the feedback circuit 64 includes resistors R64-1 and R64-2.

Figure 12:
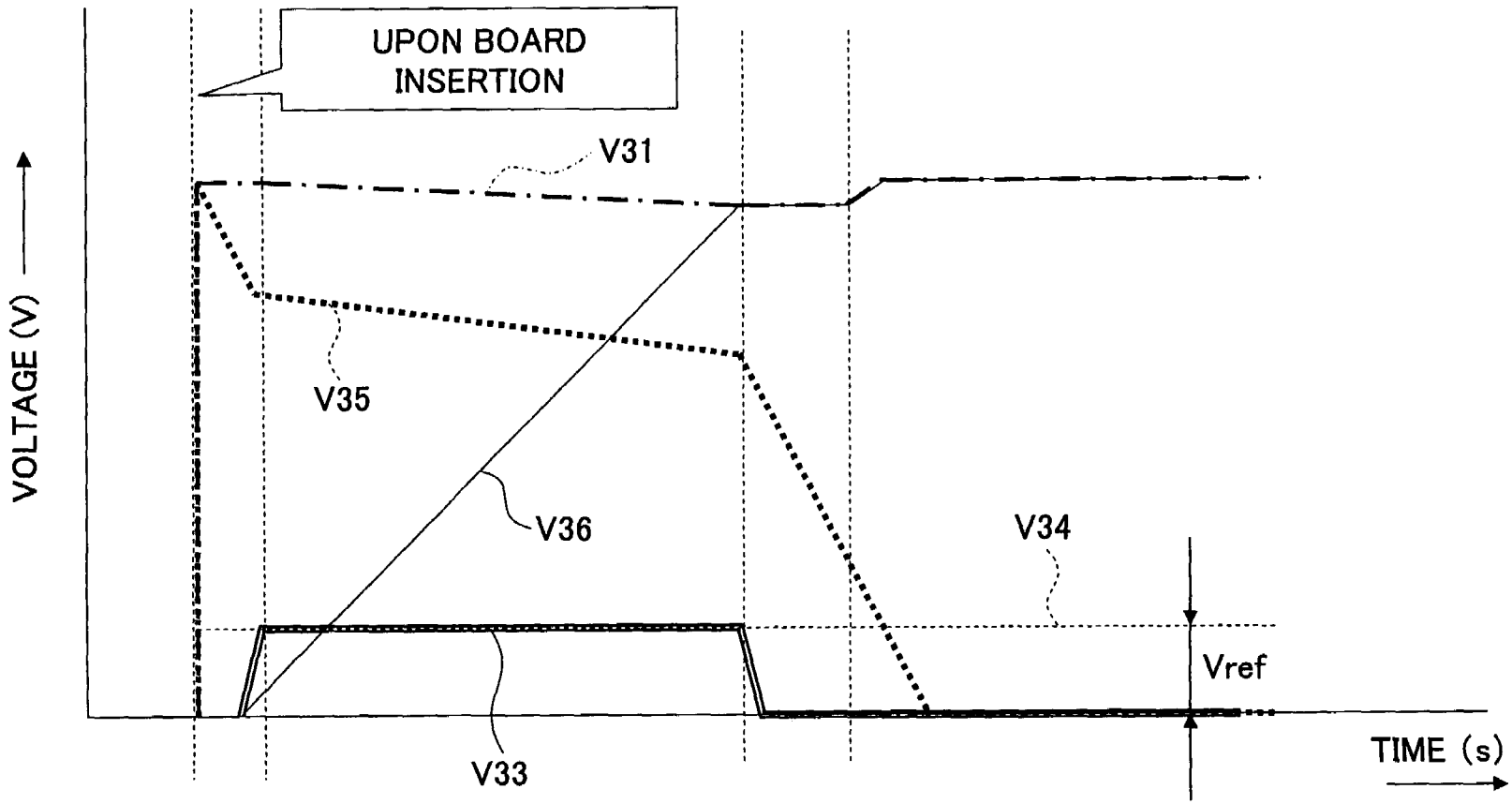
FIG. 12 shows a waveform diagram of the power supply control circuit in the fifth embodiment of the present invention.

The circuit configuration other than this is the same as that in the second embodiment described above with reference to FIG. 4, also the functions thereof are also the same (see FIG. 12), and duplicated description is omitted.

In the fifth embodiment, after the completion of the power supply starting-up operation the same as that of the second embodiment (Step S11 in FIG. 13), the alternate-current coupling circuit C63 and R63 takes the power supply voltage V36 applied to the load circuit 200. Then, the differential amplifier A65 outputs a voltage corresponding to a difference between the power supply voltage V36 and the reference voltage Vref provided by the reference voltage source 61. This output voltage is then applied to the transformer T31.

Figure 13:
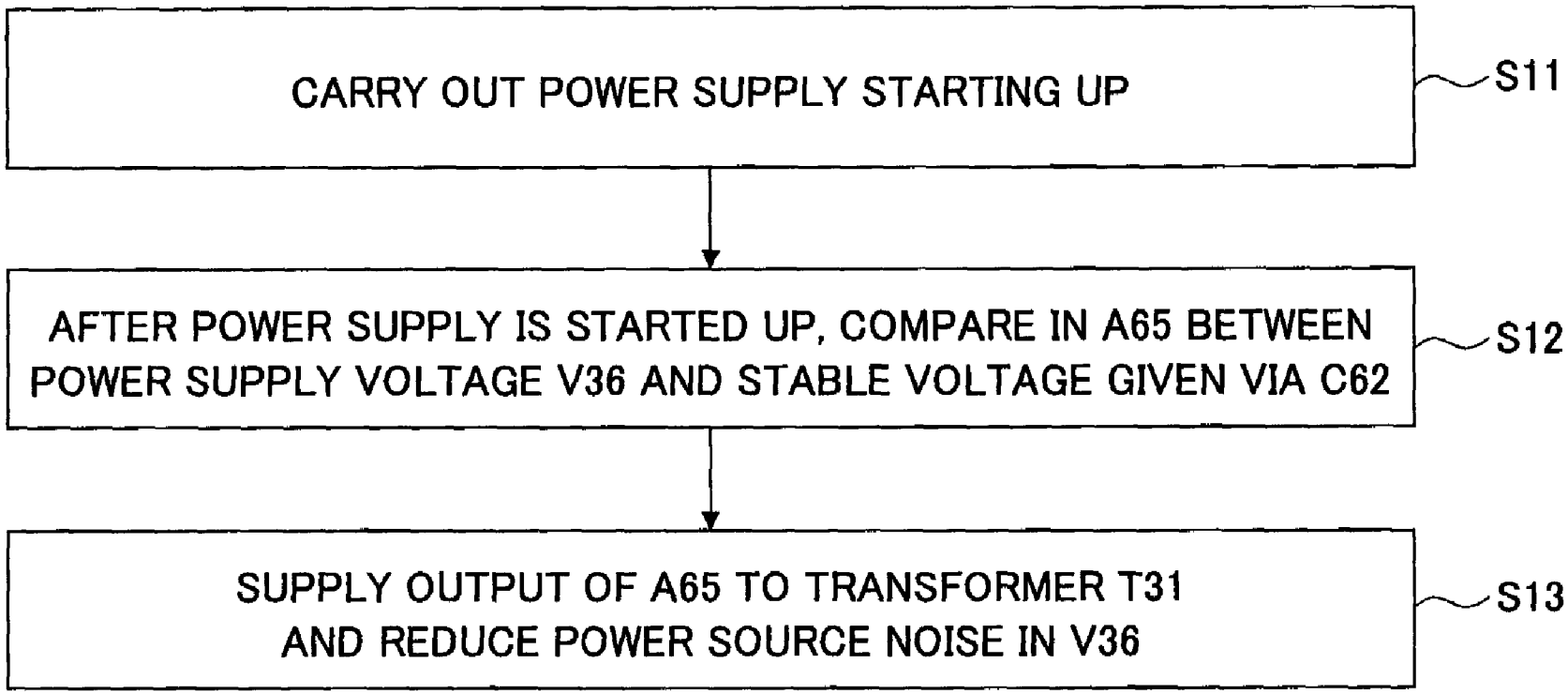
FIG. 13 shows an operation flow chart of the power supply control circuit in the fifth embodiment of the present invention.

In this configuration, the difference between the power supply voltage V36 applied to the load circuit 200 and the stable voltage applied via the capacitor C62 acting as the alternate-current coupling circuit is detected as a power supply voltage noise component (Step S12 of FIG. 13). Then, such an electric current as to cancel out the noise component is then supplied to the power supply line V31 via the transformer T36 (Step S13).

The feedback circuit 64 feeds back the output voltage of the differential amplifier A65, and thus, adjusts a control amount provided by the differential amplifier A65. As a result, a highly accurate power source noise canceling function (attenuation function) can be achieved.

That is, in the related art, power source noise is attenuated with the use of a passive circuit such as a coil, a capacitor, a resister or such, and therefore, a relatively large capacitance is required for attenuating power source noise of a frequency lower than a middle one. On the other hand, in terms of requirement to well control a rush current for a hot plug applicable board, such a capacitance connected to the power supply line should be set smaller. As a result, power supply noise control for such a frequency range may be difficult in the related art.

According to the fifth embodiment of the present invention, power source noise is actively attenuated with the use of the transformer as mentioned above, and thus, power source noise elimination effect can be effectively improved also for power source noise in the vicinity of tens of kilohertz.

Figure 14:
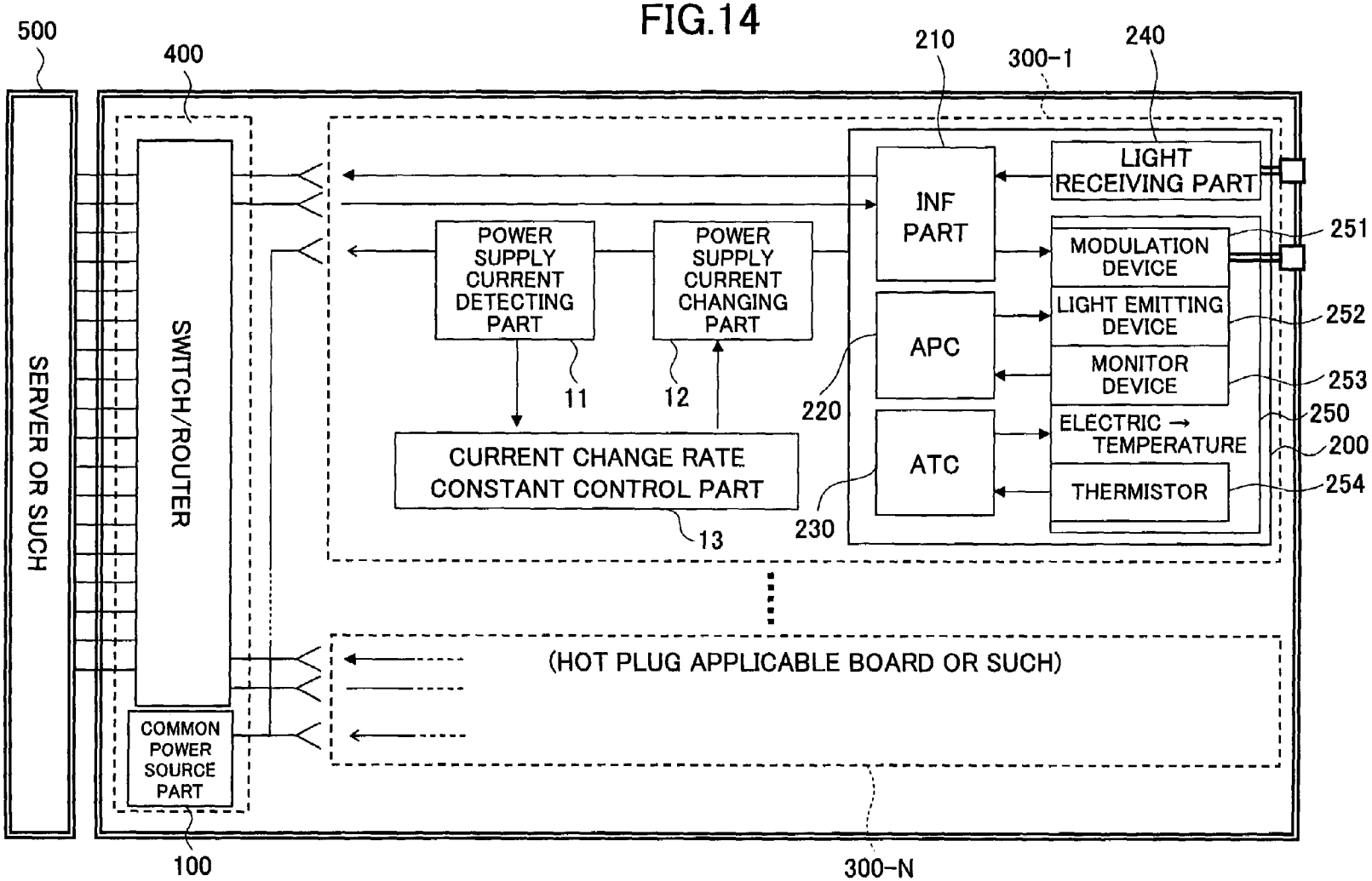
FIG. 14 shows a block diagram of an optical communication apparatus in which each of the power supply control circuits in the respective embodiments of the present invention may be applied.

FIG. 14 shows a block diagram of the entirety of an optical communication apparatus in which the power supply control circuit in each of the above-described embodiments of the present invention is loaded.

The optical communication apparatus shown is connected with a server or such 500 via a switch/router part 400, and receives/transmits information concerning optical communication carried out in the apparatus.

The optical communication apparatus has many optical modules 300-1, . . . , 300-N including the optical module 300-1 described above according to each of the embodiments of the power supply control circuit according to the present invention, loaded in its slots. Each of these optical modules includes the power supply control circuit (11, 12 and 13) according to each of the embodiments of the present invention as well as the load circuit 200 to which the power is supplied therethrough as mentioned above.

This load circuit 200 includes a light receiving part 240, an electricity-to-light converting part 250 as a light transmitting part, an interface part 210, an automatic power control (APC) part 220 and an automatic temperature control (ATC) part 230.

The electricity-to-light converting part 250 includes a modulation device 251, a light emitting device 252, a monitor device 253 and a thermistor 254.

In this configuration, an optical signal received by the light receiving part 240 connected to an optical cable is converted into an electric signal, is then sent to the interface part 210, and sent to the server or such 500 via the switch/router part 400.

On the other hand, transmission information sent from the server or such 500 is provided to the modulation device 251 via the interface part 210. The modulation part 251 modulates laser light emitted form the light emitting device 252 so as to convert the transmission information into an optical signal, and transmits it to the optical cable. At this time, the monitor device 253 monitors the optical signal, and the automatic power control part 220 controls the optical power of the optical signal in an appropriate level.

Further, based on the temperature inside of the electricity-to-light converting part 250 detected by the thermistor 254, the automatic temperature control part 230 carries out a control such that the temperature may fall within an appropriate range.

Operation in the power supply control circuit according to each of the embodiments of the present invention included in each of the optical modules 300-1, . . . , 300-N is the same as that described above for each embodiment accordingly, and duplicated description is omitted.

Figure 15:
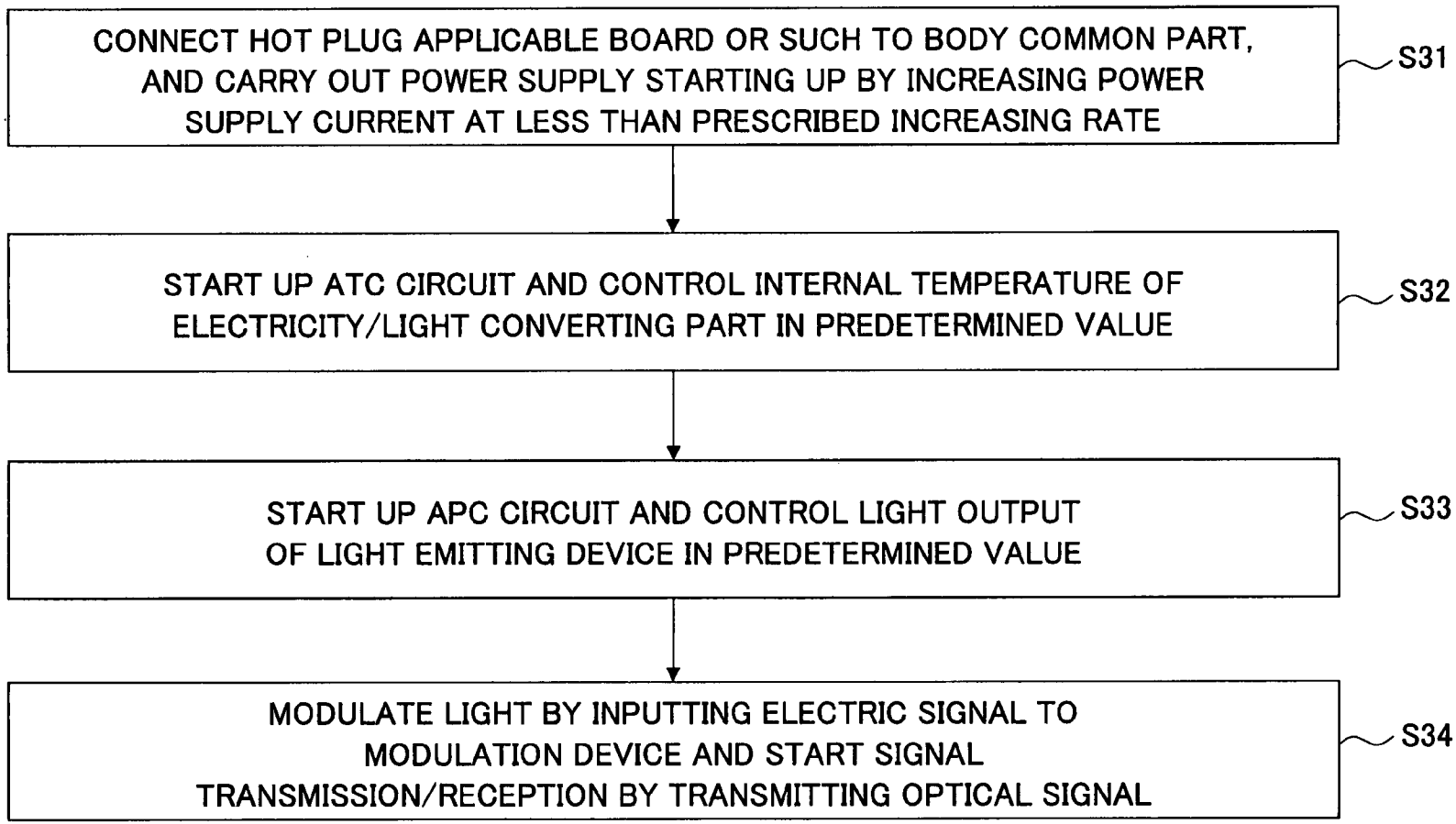
FIG. 15 shows a flow chart of a starting-up operation of the configuration shown in FIG. 14.

FIG. 15 shows an operation flow chart of the optical communication apparatus shown information FIG. 14.

Figure 16:
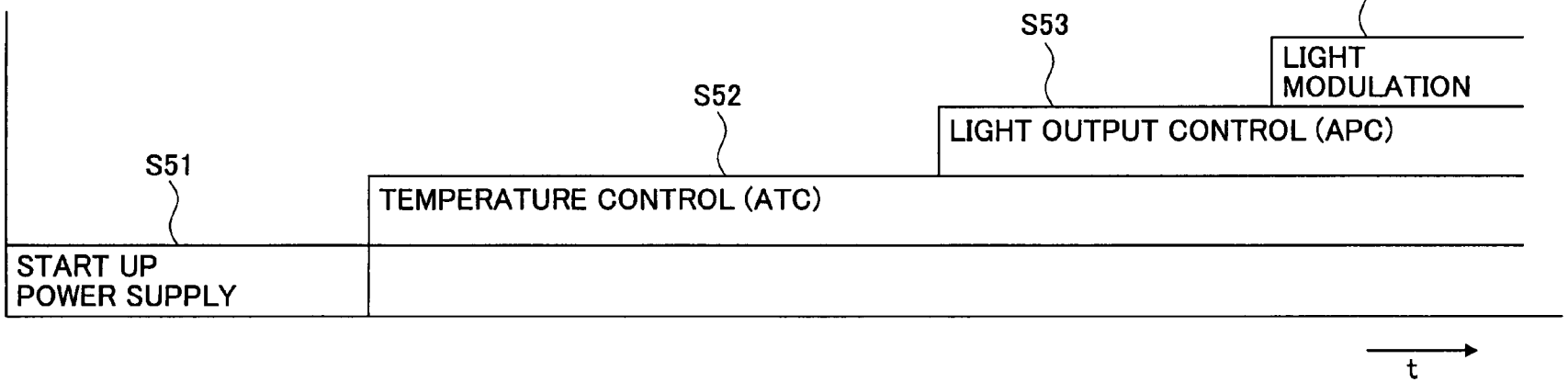
FIG. 16 shows a starting-up operation timing chart of the configuration shown in FIG. 15.

In Step S31 of the flow chart, when each optical module is inserted in a corresponding slot of a body common part including the body power source part 100 of the apparatus body, the power supply starting-up operation is automatically carried out by the power supply control circuit as described above for each embodiment of the present invention (Step S51 of FIG. 16).

In Step S32, the automatic temperature control part 230 controls the temperature inside of the electricity-to-light converting part 250 (Step S52). After that, in Step S33, the automatic power control part 220 controls optical output of the light emitting device 252 (Step S53). After that, the modulation device 251 modulates the transmission electric signal into the optical signal in the optical modulation manner, and thus, actual optical communication operation is started (Step S54).

After through the series of operation shown in FIGS. 15 and 16, each optical module 300-1, . . . , 300-N starts optical communication (optical transmission/reception). During this period, the power supply starting-up operation (Steps S31, S51) is carried out, and after that, the respective starting-up operation (Steps S32 through S34, S53 through S54) are carried out in sequence.

Accordingly, the power supply starting-up operation of the power supply control circuit according to each embodiment of the present invention should be completed within a short period to be followed by the other respective starting-up operation. According to each embodiment of the present invention, the increasing rate of the power supply current supplied to the load circuit 200 can be kept constant in the power supply starting-up operation, as mentioned above. Thereby, the power supply staring-up operation can be completed within a minimum starting-up time while influence of the rush current occurring there on operation of other circuits can be controlled to the minimum. As a result, the entire starting-up operation shown in FIGS. 15 and 16 can be proceeded smoothly.

The transistor Tr27 acting as the power supply current changing part corresponds to a conducting part or an impedance inserting part; the resistor S21 acting as the power supply current detecting part corresponds to a current-to-voltage converting part; and the time-constant circuit 26 corresponds to an integrating part. Further, the transistor Tr43 acting as the switching part corresponds to a bypass part bypassing the current-to-voltage converting part.

Further, the present invention is not limited to the above-described embodiments, and variations and modifications may be made without departing from the basic concept of the present invention claimed below.

The present application is based on Japanese Priority Application No. 2005-080668, filed on Mar. 18, 2005, the entire contents of which are hereby incorporated by reference.

What is claimed is:

1. A power supply control circuit comprising:

a conducting part configured as controllable in its conducting amount for conducting a power supply current to a load circuit;

a current change rate detecting part detecting a change rate of the power supply current supplied to the load circuit; and a control part controlling the conducing amount of the conducting part according to the change rate of the power supply current detected by the current change detecting part, wherein:

said control part carries out feedback control in such a manner as to reduce an increasing rate in the conducting amount of the conducting part as the power supply current change rate becomes larger, and carries out control in such a manner as to keep the increasing rate in the conducting amount constant.

2. A power supply control circuit comprising:

an impedance inserting part inserted in a circuit supplying a power supply current to a load circuit;

a current change rate detecting part detecting a change rate of the power supply current supplied to the load circuit; and a control part controlling an impedance of the impedance inserting part according to the change rate of the power supply current detected by the current change detecting part, wherein:

said control part carries out feedback control in such a manner as to reduce a reduction rate in the impedance of the impedance inserting part as the power supply current change rate becomes larger, and carries out control in such a manner as to keep the reduction rate in the impedance constant.

3. A power supply control circuit comprising:

a conducting part configured as controllable in its conducting amount for conducting a power supply current to a load circuit;

a current change rate detecting part detecting a change rate of the power supply current supplied to the load circuit; and a control part controlling the conducing amount of the conducting part according to the change rate of the power supply current detected by the current change detecting part, wherein:

said control part carries out feedback control in such a manner as to reduce an increasing rate in the conducting amount of the conducting part as the power supply current change rate becomes larger;

said current change rate detecting part comprises a differentiating circuit differentiating a voltage amount corresponding to the power supply current amount supplied to the load circuit; and said control part comprises a comparing part comparing an output amount of the differentiating circuit with a reference amount, and an integrating circuit integrating an output amount of said comparing part.

4. A power supply control circuit comprising:

an impedance inserting part inserted in a circuit supplying a power supply current to a load circuit;

current change rate detecting part detecting a change rate of the power supply current supplied to the load circuit; and a control part controlling an impedance of the impedance inserting part according to the change rate of the power supply current detected by the current change detecting part, wherein:

said control part carries out feedback control in such a manner as to reduce a reduction rate in the impedance of the impedance inserting part as the power supply current change rate becomes larger;

said current change rate detecting part comprises a differentiating circuit differentiating a voltage amount corresponding to the power supply current amount supplied to the load circuit; and said control part comprises a comparing part comparing an output amount of the differentiating circuit with a reference amount, and an integrating circuit integrating an output amount of said comparing part.

5. A power supply control circuit comprising:

a conducting part configured as controllable in its conducting amount for conducting a power supply current to a load circuit;

a current change rate detecting part detecting a change rate of the power supply current supplied to the load circuit; and a control part controlling the conducing amount of the conducting part according to the change rate of the power supply current detected by the current change detecting part, wherein:

said control part carries out feedback control in such a manner as to reduce an increasing rate in the conducting amount of the conducting part as the power supply current change rate becomes larger;

said current change rate detecting part comprises a current-to-voltage converting part converting the power supply current amount supplied to the load circuit to a voltage amount;

a starting-up detecting part detecting a completion of power supply starting-up operation for the load circuit by detecting a power supply voltage applied to the load circuit; and a bypass part bypassing the current-to-voltage converting part upon detecting the power supply starting-up operation completion by the starting-up detecting part.

6. A power supply control circuit comprising:

an impedance inserting part inserted in a circuit supplying a power supply current to a load circuit;

a current change rate detecting part detecting a change rate of the power supply current supplied to the load circuit; and a control part controlling an impedance of the impedance inserting part according to the change rate of the power supply current detected by the current change detecting part, wherein:

said control part carries out feedback control in such a manner as to reduce a reduction rate in the impedance of the impedance inserting part as the power supply current change rate becomes larger;

said current change rate detecting part comprises a current-to-voltage converting part converting the power supply current amount supplied to the load circuit to a voltage amount;

a starting-up detecting part detecting a completion of power supply starting-up operation for the load circuit by detecting a power supply voltage applied to the load circuit; and a bypass part bypassing the current-to-voltage converting part upon detecting the power supply starting-up operation completion by the starting-up detecting part.

7. A control method of a power supply control circuit comprising a conducting part configured as controllable in its conducting amount for conducting a power supply current to a load circuit, comprising:

a current change rate detecting step of detecting a change rate of the power supply current supplied to the load circuit; and a control step of controlling the conducting amount of the conducting part according to the change rate of the power supply current detected in said current change detecting step, wherein:

said control step comprising the step of carrying out feedback control in such a manner as to reduce an increasing rate in the conducting amount of the conducting part as the power supply current change rate becomes larger, and carries out control in such a manner as to keep the increasing rate in the conducting amount constant.

8. A control method of a power supply control circuit comprising an impedance inserting part configured to be controllable in its impedance and inserted in a circuit supplying a power supply current to a load circuit, comprising:

a current change ratio detecting step detecting a change rate of the power supply current supplied to the load circuit; and a control step controlling an impedance of the impedance inserting part according to the change rate of the power supply current detected in said current change detecting step, wherein:

said control step comprises the step of carrying out feedback control of reducing a reduction rate in the impedance of the impedance inserting part as the power supply current change rate is larger, and carries out control in such a manner as to keep the reduction rate in the impedance constant.

9. A control method of a power supply control circuit comprising a conducting part configured as controllable in its conducting amount for conducting a power supply current to a load circuit, comprising:

a current change rate detecting step of detecting a change rate of the power supply current supplied to the load circuit; and a control step of controlling the conducting amount of the conducting part according to the change rate of the power supply current detected in said current change detecting step, wherein:

said control step comprising the step of carrying out feedback control in such a manner as to reduce an increasing rate in the conducting amount of the conducting part as the power supply current change rate becomes larger;

said power supply control circuit comprises, for detecting the change rate of the power supply current in said current change rate detecting step, a current-to-voltage converting part converting the power supply current supplied to the load circuit to a voltage, and a bypass part bypassing the current-to-voltage converting part; and said method further comprises:

a start-up detecting step of detecting a completion of power supply starting-up operation for the load circuit by detecting a power supply voltage applied to the load circuit; and a step of making said bypass part conductive to bypass said current-to-voltage converting part upon detection of the power supply starting-up operation completion in said starting-up detecting step.

10. A control method of a power supply control circuit comprising an impedance inserting part configured to be controllable in its impedance and inserted in a circuit supplying a power supply current to a load circuit, comprising:

a current change ratio detecting step detecting a change rate of the power supply current supplied to the load circuit; and a control step controlling an impedance of the impedance inserting part according to the change rate of the power supply current detected in said current change detecting step, wherein:

said control step comprises the step of carrying out feedback control of reducing a reduction rate in the impedance of the impedance inserting part as the power supply current change rate is larger;

said power supply control circuit comprises, for detecting the change rate of the power supply current in said current change rate detecting step, a current-to-voltage converting part converting the power supply current supplied to the load circuit to a voltage, and a bypass part bypassing the current-to-voltage converting part; and said method further comprises:

a start-up detecting step of detecting a completion of power supply starting-up operation for the load circuit by detecting a power supply voltage applied to the load circuit; and a step of making said bypass part conductive to bypass said current-to-voltage converting part upon detection of the power supply starting-up operation completion in said starting-up detecting step.

* * * * *